United States Patent [19]

Iue-Tzung et al.

[11] Patent Number: 4,847,922

[45] Date of Patent: Jul. 18, 1989

[54] COMBINED TOILET SEAT AND REELABLE SEAT COVER

[76] Inventors: Hung Iue-Tzung, No. 184, Chung Shan Rd., Fuang-Yuan, Taichung; Jang Wen-Cherng, No. 8-2, Lane 31, Wen-Shyue Rd., Feng-Shan, Tainan; Lee Li-Gung, No. 184, Chung Shan Rd., Fuang-Yuan, Taichung, all of Taiwan

[21] Appl. No.: 171,852

[22] Filed: Mar. 22, 1988

[51] Int. Cl.[4] ..... A47K 13/22; A47K 13/14

[52] U.S. Cl. ..... 4/247; 4/242

[58] Field of Search ..... 4/234, 237, 242, 243, 4/244, 245, 246, 247, 251, 240; 242/55.2, 55.3, 55.42, 76

[56] References Cited

U.S. PATENT DOCUMENTS

| | | | |
|---|---|---|---|
| 4,213,212 | 7/1980 | Hefty | 4/243 |
| 4,566,648 | 1/1985 | Hefty | 4/242 |
| 4,662,009 | 5/1987 | Hefty | 4/247 |
| 4,760,613 | 8/1988 | Bobak | 4/243 |
| 4,766,618 | 9/1988 | Boker | 4/247 |

*Primary Examiner*—Henry J. Recla
*Assistant Examiner*—Glenn T. Barrett
*Attorney, Agent, or Firm*—Ladas & Parry

[57] ABSTRACT

A combined toilet seat and reelable seat covering device includes a U-shaped seat plate and a flexible lay-flat tube cover adapted to be sleeved on the seat plate. One end of the seat is mounted on a mounting plate and rollers are provided for clamping and positioning the end of the seat. The used length of the tube sheet can be removed from the seat plate by passing between the rollers. A motor which operates a wind-up roller is controlled by a friction roller over which the tensed tube cover passes upstream of the wind-up roller and a speed reducing gear assembly which is associated with the friction roller. The speed reducing seat assembly incorporates a spring plate to de-energize a switch of the motor when a predetermined length of the tube cover is removed from the seat and wound on the wind-up roller.

12 Claims, 4 Drawing Sheets

COMBINED TOILET SEAT AND REELABLE SEAT COVER

BACKGROUND OF THE INVENTION

This invention relates to a tiolet seat and particularly to a combined toilet seat and reelable seat cover.

It is known that the most commonly used toilet seat includes merely a looped seat which is mounted pivotally on a bowl and is bare so that it is in direct contact with every body who occupies it. For sanitation purposes, an improved toilet seat assembly has been developed which includes a flexible cover in the form of a lay-flat tube A to be sleeved on a U-shaped seat plate B through a free end A1 of the seat plate as shown in FIG. 1. The cover can be sleeved on the U-shaped seat plate and a used length of the cover can be reeled up through a motor (not shown) and removed from the seat. Such a device includes a cutting means C for slitting the lay-flat tube into a sheet so that, during winding, the sheet can pass through the end of the seat plate which is secured to a mounting plate D. Since the cutting means C is exposed, in many cases it hurts the person who assembles the device or who loads or unloads the reel of cover tube.

Moreover, the device has a drawback in that the wind-uproller E, which is removably mounted on an output shaft of the motor, is provided with a notch which is liable to disengage from a stud of the output shaft. In some cases, the motor idles since the wind-up roller disengage from the output shaft.

In addition, the reference marks provided on the cover tube for showing the length of the cover being used can not effectively show the real length of the used cover tube since the position of the marks may vary due to the fact that the lengths of the cover unreeled by different persons may be different. Sometimes, the used portion of the cover tube may remain on the seat, and sometimes an excess length of the cover tube may be undesirably wound up.

SUMMARY OF THE INVENTION

An object of the invention is to provide a combined toilet seat and reelable seat covering device which is safe and permits the cover tube to be released from a mounted end of the toilet seat without using a cutting means.

Another object of the invention is to provide a combined toilet seat and reelable seat covering device which can remove an accurate used length of the cover tube.

According to the invention, a combined toilet seat and reelable seat covering device comprises: a seat mounting plate; a substantially U-shaped seat having a first end portion mounted on the mounting plate member and extending forwardly from the seat mounting plate and having a free second end extending back to the mounting plate, the first end portion having a top face, a bottom face, and two opposite side faces; a In one aspect of the invention, the device further comprises means for limiting the length of the sheet cover to be wound up by the wind-up roller, the limiting means including an electric switch to control the operation of the driving means, a friction roller which is mounted on the mounting plate upstream of the wind-up roller for rotation upon being frictioned by the flexible tube cover, a speed reducing gear assembly associated with the friction roller, the gear assembly including a gear which incorporates a spring plate to act on the switch so as to de-energize it when a predetermined used length of said cover tube is wound up.

The presently preferred embodiment of the invention will be described in detail with reference to the following drawings, in which

DETAILED DESCRIPTION OF THE PREFERRED EMBODIMENT

Figure 2:
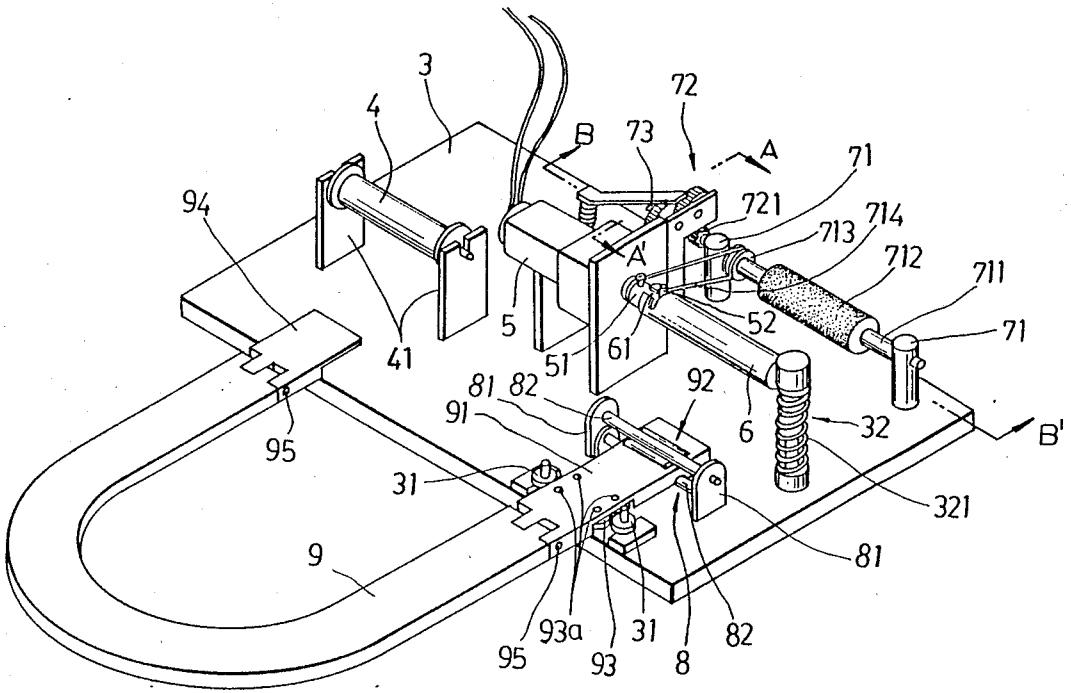
FIG. 2 is an exploded view of the combined toilet seat and reelable seat cover device according to the present invention.
Figure 5:
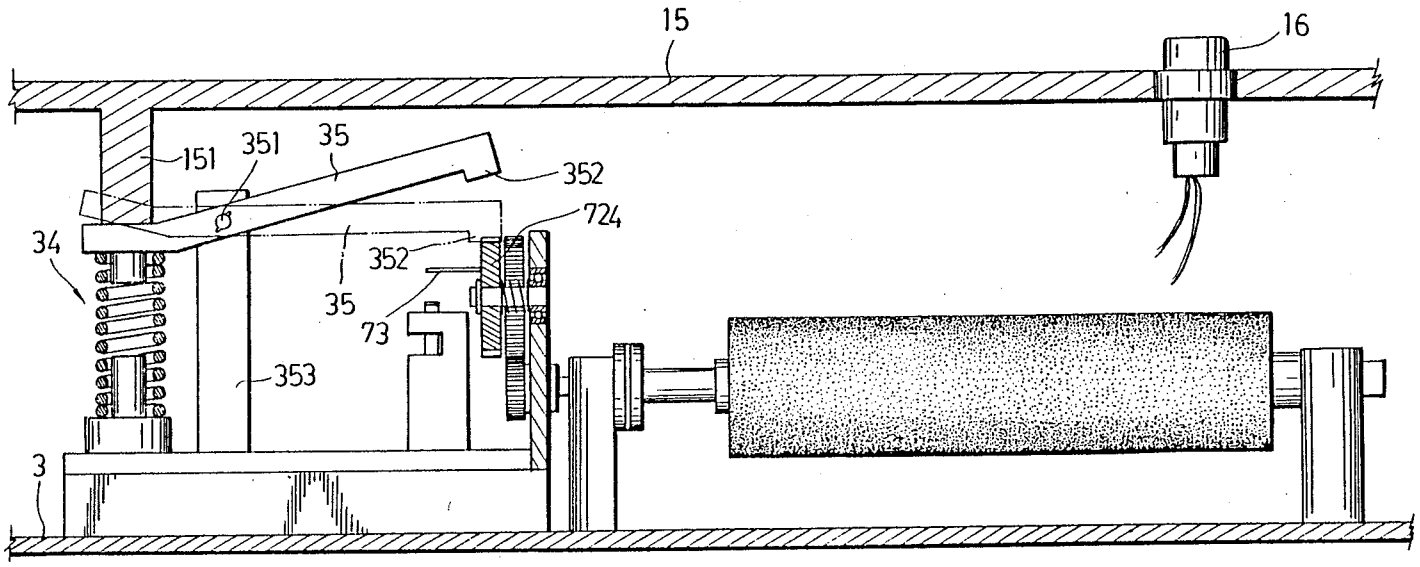
FIG. 5 is a sectional view taken along line B–B′ of FIG. 2.

Referring to FIGS. 2 and 5, a preferred embodiment of the present invention is shown, including a seat mounting plate 3 to be mounted on a toilet bowl. Attached to the seat mounting plate 3 is a seat member which has a U-shaped seat plate 9 connected through pins 95 to an end segment 91 mounted on the mounting plate 3 and a second end segment 94 which rests on the plate 3. The U-shaped seat plate 9 is turnable relative to the end segments 91 and 94. The end segment 91 is provided with a recess opening at the bottom side thereof and receiving four rollers 93 which are carried by shafts journalled in end segment 91 at 93a and another recess receiving four contacting horizontal rollers 92 which are mounted on the end segment 91. The means for mounting the end segment 94 includes two elastic brackets 81 which are mounted on the mounting seat 3, upper and lower rotatable horizontal rods 82 mounted on the brackets 81 for holding therebetween the end segment 91, the rotatable rods 82 rotatably contacting the rollers 92 of the end segment 91, and two rollers 31 respectively rotatable about two vertical axes on both sides of the end segment 91, each roller 31 rotatably contacting two rollers 93. With the rollers 31 and the rotatable rods 82, the end segment 91 is mounted immovably on the mounting seat 3.

A reel 4 is mounted removably on two brackets 41 which in turn are mounted on the mounting plate 3. The reel 4 carries a flexible sheet cover in the form of a lay-flat tube which is adapted to be sleeved on the U-shaped plate 9 through the free end segment 94 of the seat 9. The flexible sheet cover may be made of a plastic material or paper.

Figure 3:
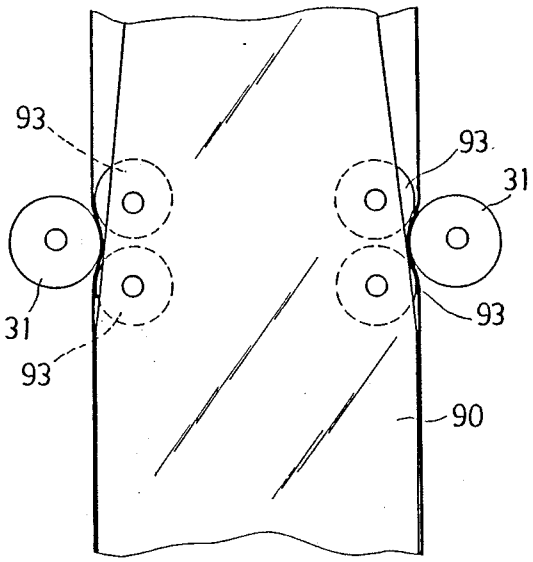
FIG. 3 is a schematic view showing how the lay-flat tube passes between rollers.

A wind-up sleeve roller 6 is sleeved removably on an output shaft 51 of a motor 5 which is mounted on the mounting seat 3. The sleeve roller 6 is provided with a notch 61 which is substantially T-shaped to engage releaseably with a stud 52 of the output shaft 51. The sleeve roller 6 can be detached from the shaft 51 by releasing the stud 52 from the notch 61. A post 32 is mounted on the mounting plate 3 and loaded with a helical spring 321 which provides a measure of resiliency. The post 32 is provided with a hole (not shown) to receive one end of the sleeve shaft 6. the end of the sleeve shaft can be inserted in the hole of the post 32 by slightly pushing away the post 32. The post permits the end of the sleeve shaft 6 to be released from the hole when it is moved slightly away from the sleeve shaft 6. The wind-up sleeve roller 6 can wind up the used portion of the flexible sheet cover by the driving of the motor 5. When the used sheet cover 90 is wound up by the sleeve roller 6, the used sheet cover will move between the rollers 31 and 93 (see FIG. 3) and between the rollers 82 and 91, thereby being released from the end segment 91.

In order to completely wind up the used length of the cover sheet or an exact length of the cover sheet after the seat has been occupied, a means is provided for stopping the operation of the wind-up roller 6 when a predetermined length of the cover sheet is wound up. This means includes a friction roller 712 mounted on a shaft 711 which in turn is mounted rotatably on two supports 71. The friction roller 712 can be rotated by the motor 5 through a transmission belt 714 which passes over the roller 713 and the motor shaft 51. On the other hand, the friction roller 713 can be turned when the cover tube passes over the friction roller 712 and then is wound up by the wind-up sleeve roller 6. The friction roller 712 can be rotated simultaneously with the sleeve roller 6 by the movement of the tensed cover sheet.

Figure 1:
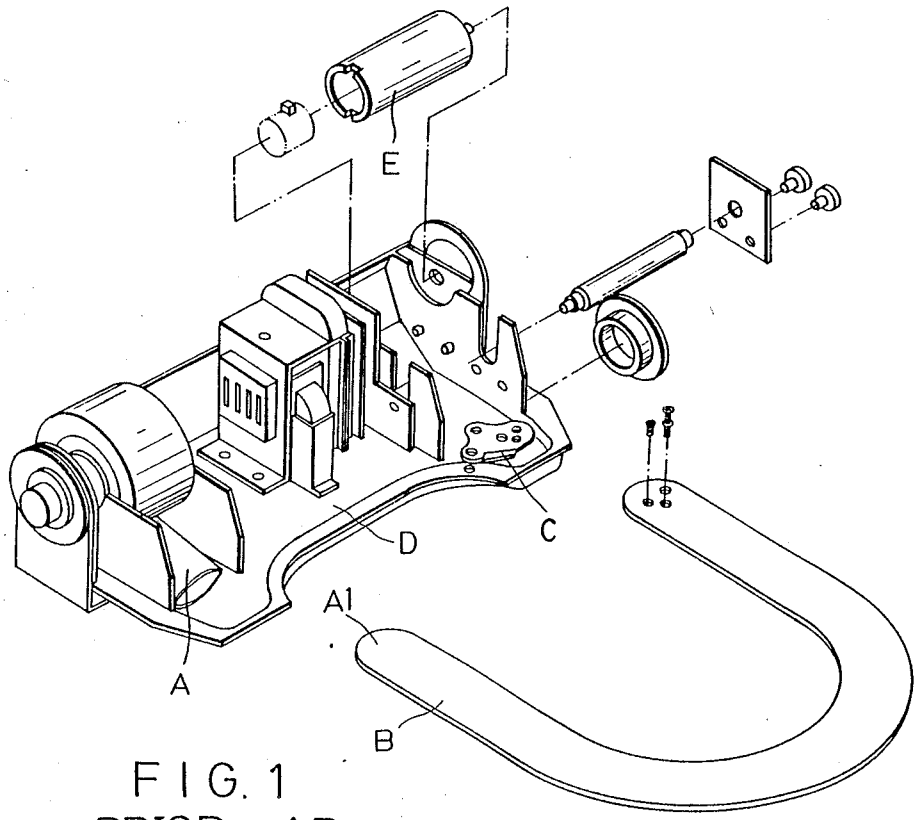
FIG. 1 PRIOR ART
FIG. 1 is an exploded view of the prior art.
Figure 4:
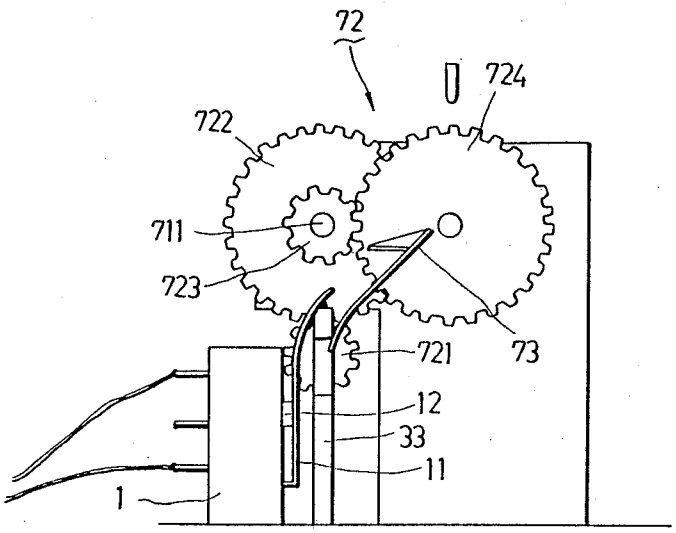
FIG. 4 is a sectional view taken along line A–A′ of FIG. 2.

Referring to FIG. 1 in combination with FIG. 4, a speed reducing gear assembly 72 is operably associated with the shaft 711. The gear assembly 72 includes a gear 721 which is mounted on one end of the shaft 711, a gear 722 with a larger diameter mounted adjacent to and engaging the gear 711, a gear 723 with a smaller diameter mounted coaxially with the gear 722, and a gear 724 with a larger diameter mounted adjacent to and engaging the gear 723. The speed of the gear 724 is substantially slower than that of the gear 721 or the shaft 711. The speed of the gear 724 is arranged in such a manner that it makes one turn as the friction roller 712 and the gear 721 make several predetermined turns so as to completely reel up the used length of the cover sheet from the seat 9.

A stop spring plate 73 is attached to the gear 724. An upright partition plate 33 is provided adjacent to the gear 724, and a microswitch 1 is installed at the other side of the partition plate 33. The microswitch 1 is provided with a control member 12 connected to an actuating plate 11 which is adjacent to the partition plate 33 and has a free end extending over the top of the partition plate 33. When the gear 724 rotates one turn, the stop spring plate 73, which moves together with the gear 724, will extend into the opening 331 of the partition plate 33 one time. After the spring plate 73 extends into the opening 331, it moves upward, then is released from the opening 331 and flex to slide along the partition plate 33 until it passes the top of the partition plate 33 and suddenly stretches. When the spring plate 73 suddenly stretches, it strikes the actuating plate 11, stopping the motor operation.

Referring to FIG. 5, a cover 15 is provided on the mounting plate 3, and a means is provided for immobilizing the gear 724 when the mounting plate 3 is uncovered. The means including a spring loaded rod 34 mounted on the mounting plate 3 near the gear 724. To the top end of the rod 34 is attached an engaging member 35 which is fulcrumed at 351 on a support 353. The engaging member 35 has detent projection 352 which can be caused to engage the gear 724 to prevent the gear from moving when the springloaded rod 34 is depressed.

The cover 15 of the mounting plate is provided with a depressing member 151 which depresses the rod 34 when the cover 15 is disposed on the mounting plate 3. As the rod 34 is depressed, the engaging member 35 turns and moves away from the gear 724. In this situation, the gear assembly and the friction roller 712 are operative.

A switch 16 is mounted on the cover 15 and connected to the motor so as to be controlled by the user. In operation, the user may depress the switch 16 to actuate the motor 5 so that the sheet cover is wound up. When the engaging member 73 actuates the micro switch 1, the motor stops its operation and the used predetermined length of the sheet cover is reeled upand thereby removed from the seat 9.

It can be appreciated that the reel 4 of plastic sheet cover can be mounted on the mounting plate by removing the cover 15 and putting the two ends of the reel 4 in two notches of the brackets 41. In assembly, the sheet cover is unreeled, then sleeved on the end segment 94 of the U-shaped seat 9, and drawn to the other end segment 91. The end segment 91 is placed between the rollers 31 and placed on the lower horizontal roller 82. Then, the upper horizontal roller 82 is attached to the brackets 81 by pushing the elastic brackets 81 away from one another and releasing them, thereby clamping the end segment 91 with the rollers 92 being contacted with the rollers 82. From the end segment 91, the sheet cover is drawn to pass over the friction roller 712, and then fixed to and wound on the sleeve roller 6.

When the cover 15 is closed and the switch 16 is depressed, the motor 5 rotates the sleeve roller 6, thereby reeling the sheet cover from the U-shaped seat 9. As the sheet cover is reeled, the friction roller 712 as well as the gear assembly is caused to rotate due to the movement of the tensed sheet cover on the friction roller. When the spring plate 73 of the control gear 724 turns to the partition plate and strikes the actuating plate 11 of the switch 1, the motor stops the reeling operation and the used length of the sheet cover is removed completely from the toilet seat.

The belt transmission mechanism operates only when no tension exists in the sheet cover, that is to say, when the sheet cover is removed from the reel 4 but still has a length to be wound up by the sleeve roller 6. The belt 714 of the belt transmission mechanism is narrow and arranged such that the driving friction force induced thereby is smaller than that which can be induced by the friction roller 712. Accordingly, the belt transmission mechanism idles when the friction roller is rotated by the frictioning sheet cover and will operate only when the sheet cover is not tensed and no friction force is present on the friction roller 6. The belt transmission mechanism can rotate the friction roller 6 and cause the control gear 724 and the control spring 73 to operate.

With the invention thus explained, it is apparent that various modifications and variations can be made without departing from the scope of the invention. It is therefore intended that the invention be limited only as indicated in the appended claims.

What I claim is:

1. A combined toilet seat and reelable seat covering device comprising:

a seat mounting plate;

a substantially U-shaped seat having a first end portion mounted on said mounting plate member, said U-shaped seat extending forward from said seat mounting plate and having a free second end extending back to said mounting plate, said first end portion having a top face, a bottom face, and two opposite side faces;

a reel rotatably mounted on said seat mounting plate adjacent to said free second end and adapted to carry a flexible lay-flat cover tube;

means for mounting said first end on said seat mounting plate, said means including a support for holding said first end portion at a level above said mounting plate, said support incorporating roller means at said top and bottom faces, and said side faces of said first end portion for clamping therebetween said first end portion and allowing the flexible cover tube to pass therebetween;

a wind-up roller;

a drive means for driving said wind-up roller; and means for mounting said wind-up roller on said seat mounting plate adjacent to said first end.

2. A combined toilet seat and reelable seat covering device comprising:

a seat mounting plate;

a substantially U-shaped seat having a first end portion mounted on said mounting plate member, said Ushaped seat extending forwardly from said seat mounting plate and having a free second end extending back to said mounting plate;

a reel rotatably mounted on said seat mounting plate adjacent to said free second end;

means for mounting said first end on said seat mounting plate, said means including a support which incorporates roller means for clamping therebetween said first end portion at a level above said mounting plate;

a flexible lay-flat tube cover wound on said reel, said flexible tube cover capable of being sleeved on said U-shaped seat through said free second end and passing between said roller means at said first end portion;

a wind-up roller;

a drive means for driving said wind-up roller; and means for mounting said wind-up roller on said seat mounting plate adjacent to said first end.

3. A combined toilet seat and reelable seat covering device as claimed in claim 2, in which said first end portion of said U-shaped seat includes a top face, a bottom face, two opposite side faces, a first cavity opening at said top and bottom face, and a second cavity horizontally spaced apart from said first cavity and being open at said bottom face and at both said side faces, wherein said support of said means for mounting said first end portion includes two brackets vertically extending from said seat mounting plate on two sides of said first end portion near said first cavity, said roller means including first rollers which are rotatable about a horizontal axis and which include first interior rollers attached to said first end portion in said first cavity, and first exterior rollers mounted on said bracktrs adjacent to said top and bottom faces, said first interior rollers and said first exterior rollers contacting each other, said roller means further including second rollers which are rotatable about vertical axes and includes second interior rollers attached to said first end portion in said second cavity and second exterior rollers mounted on said mounting plate adjacent to both said side faces and contacting said second interior rollers.

4. A combined toilet seat and reelable seat covering device as claimed in claim 2, in which said drive means has a rotary output shaft, and said wind-up roller is a sleeve roller which has one end sleeved around said output shaft, said shaft having an end with a radially extending pin thereon, said one end of said sleeve roller having a substantially T-shaped notch so as to engage releaseably said pin of said output shaft.

5. A combined toilet seat and reelable seat covering device as claimed in claim 4, wherein said means for mounting said wind-up roller includes a vertical post mounted on said mounting plate and a helical spring loaded thereon to provide a measure of resiliency, said vertical post having a slot to permit another end of said sleeve roller to be inserted into said slot.

6. A combined toilet seat and a reelable seat covering device as claimed in claim 2, wherein said U-shaped seat includes first and second hinged end segments to define said first and second end portions.

7. A combined toilet seat and a reelable seat covering device as claimed in claim 2, further comprising means for limiting the length of the sheet cover to be wound up by said wind-up roller, said limiting means including an electric switch to control the operation of said driving means, a friction roller which is mounted on said mounting plate upstream of said wind-up roller for rotation upon being frictioned by said flexible tube cover, a speed reducing gear assembly associated with said friction roller, said gear assembly including a gear which incorporates a spring plate to act on said switch so as to place it in a de-energized position when a predetermined used length of said cover tube is wound up.

8. A combined toilet seat and reelable seat covering device as claimed in claim 7, wherein said electric switch has an actuating plate, said limiting means further including an upright partition plate disposed between said spring plate and said actuating plate, said upright partition plate permitting said spring plate to actuate said actuating plate when said gear turns to a predetermined position.

9. A combined toilet seat and reelable seat covering device as claimed in claim 8, wherein said actuating plate has an end portion extending over a top end of said partition plate, said spring plate striking said end portion of said actuating plate when it turns from a lower position to a higher position.

10. A combined toilet seat and reelable seat covering device as claimed in claim 9, wherein said partition plate has an opening near said top end of said partition plate, said spring plate entering said opening, then being bent and released from said opening upon upward movement and finally stretching suddenly to strike said actuating plate when moving past said top end.

11. A combined toilet seat and reelable seat covering device as claimed in claim 7, further comprising a belt drive mechanism for transmitting movement from said output shaft to said shaft of said friction roller, said belt drive mechanism being operative when no friction force is induced on said friction roller.

12. A combined toilet seat and reelable seat covering device as claimed in claim 7, further comprising means for covering said mounting plate and means for preventing said gear from movement when said covering means is removed, said preventing means having a pawl member to engage with said gear, said covering means having a means for depressing said pawl member to disengage from said gear when said mounting plate is covered.

* * * * *

UNITED STATES PATENT AND TRADEMARK OFFICE

CERTIFICATE OF CORRECTION

PATENT NO. : 4,847,922

DATED : July 18, 1989

INVENTOR(S) : Iue-Tzung HUNG et al

It is certified that error appears in the above-identified patent and that said Letters Patent is hereby corrected as shown below:

Title page, item [19] should read --Hung et al--

FULL NAME OF THE INVENTORS SHOULD READ AS FOLLOWS:

Iue-Tzung HUNG et al and NOT

Hung IUE-TZUNG et al

Wen-Cherng JANG and NOT

Jang WEN-CHERNG

Li-Gung LEE and NOT

Lee LI-GUNG

Signed and Sealed this

Twenty-fifth Day of June, 1991

*Attest:*

*Attesting Officer*

HARRY F. MANBECK, JR.

*Commissioner of Patents and Trademarks*